United States Patent [19]

Narra

[11] 4,342,724

[45] Aug. 3, 1982

[54] RED CELL LABELING VIAL

[75] Inventor: Rama K. Narra, North Brunswick, N.J.

[73] Assignee: E. R. Squibb & Sons, Inc., Princeton, N.J.

[21] Appl. No.: 180,209

[22] Filed: Aug. 21, 1980

[51] Int. Cl.[3] ..... B01L 3/00; B01L 11/00

[52] U.S. Cl. ..... 422/101; 422/102; 233/26; 210/927; 210/532.1; 128/218 M

[58] Field of Search ..... 210/927, 532.1, 538; 215/1 R, 247; 422/101, 102; 23/230 B; 128/218 M, 760, 763; 435/296; 233/26, 1 R

[56] References Cited

U.S. PATENT DOCUMENTS

| | | | |
|---|---|---|---|
| 3,072,261 | 1/1963 | Smith | 210/532.1 |
| 3,849,072 | 11/1974 | Ayres | 233/26 |
| 3,920,995 | 11/1975 | Czaplinski et al. | 250/493 |
| 3,932,222 | 1/1976 | Dorn | 128/218 M |
| 4,031,895 | 6/1977 | Porter | 128/218 M |
| 4,131,512 | 12/1978 | Dorn | 435/296 |

*Primary Examiner*—Frank W. Lutter
*Assistant Examiner*—Chris Konkol
*Attorney, Agent, or Firm*—Lawrence S. Levinson; Burton Rodney

[57] ABSTRACT

A container having a container tube with a central tube chamber and apertures at both ends with a resilient plug over each aperture, a weir extending into the central tube chamber.

The container is useful for drawing blood and labeling it with Tc-99.

The container is sterile and sealed at less than atmospheric pressure inside.

10 Claims, 2 Drawing Figures

RED CELL LABELING VIAL

CROSS-REFERENCE TO RELATED APPLICATION

A related application Ser. No. 179,306 is being filed Aug. 18, 1980, still pending.

BRIEF SUMMARY OF THE INVENTION

A container having a container tube with a central tube chamber and apertures at both ends with a resilient plug over each aperture, a weir extending into the central tube chamber.

The container is useful as a vial for drawing blood, centrifuging the blood and labeling the red blood cells with Tc-99$^m$.

The container is sterile and sealed with less than atmospheric pressure inside.

DETAILED DESCRIPTION OF THE INVENTION

Figure 1:
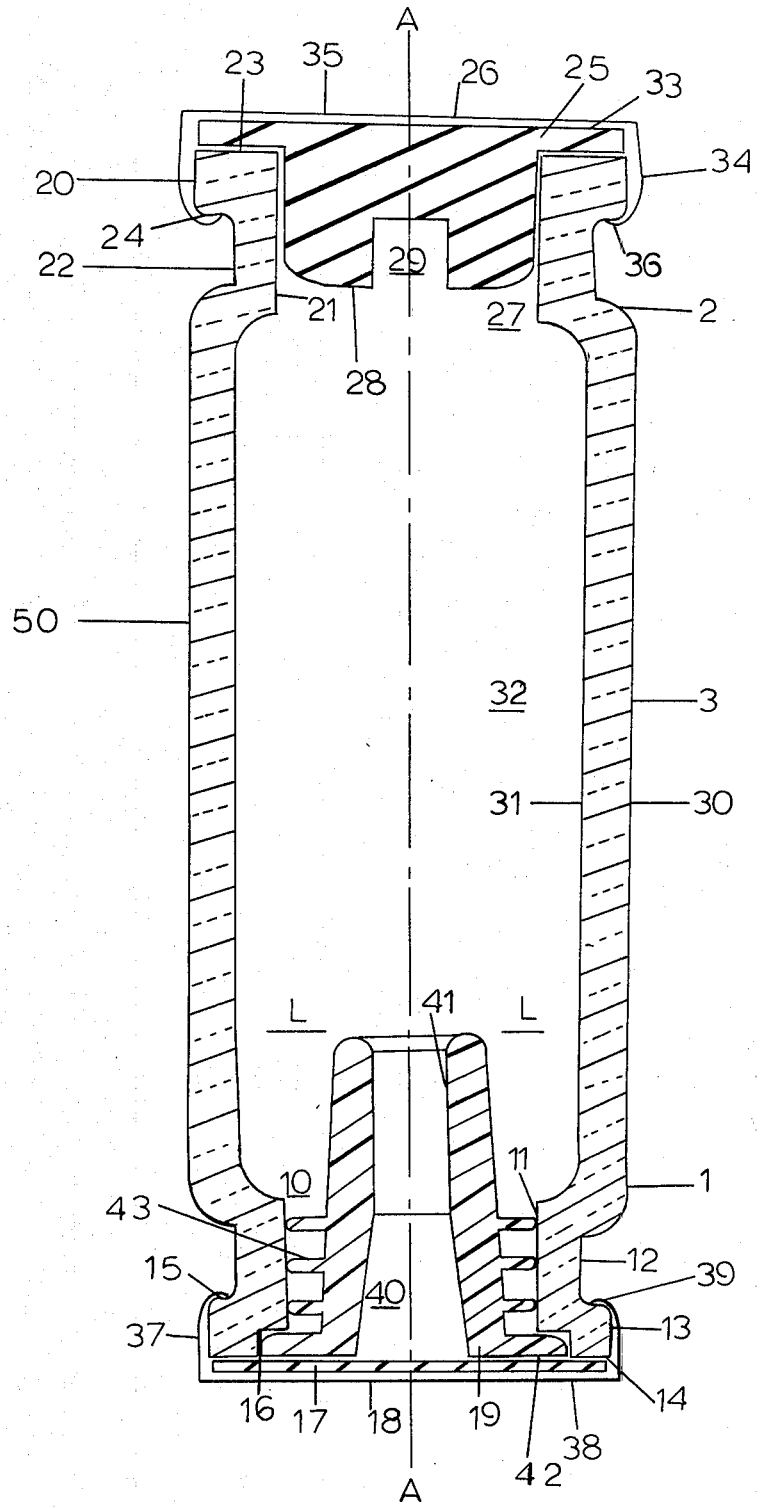
FIG. 1 is a cross sectioned view of a preferred embodiment centrifuge container tube of the invention.

In a preferred embodiment of the invention there is a centrifuge tube container as shown in FIG. 1.

The container 50 has a first end member 1 a second end member 2 and a central member 3. The first end member is integrally attached to the central member. The second end member is integrally attached to the central member.

The central member 3 is substantially cylindrical around a central centrifuge tube container axis A—A. The central member 3 has an outer cylindrical wall surface 30 and a cylindrical wall inner surface 31. The central member inner surface 31 defines a central member inner chamber 32;

The second end member 2 has a second end inner surface 21, a second end upper outer side surface 20, second end lower outer side surface 22, second end top surface 23, second end outer flange 24, second end plug means 25 and second end seal means 26;

The second end inner surface 21 is cylindrical around the central container axis, A—A and defines a second end inner channel 27 therewithin.

The second end inner channel 27 is in fluid flow communication with the central member inner chamber 32.

The first end member 1 has a first end inner surface 11, first end upper side surface 12 and first end lower side surface 13, first end bottom surface 14, first end outer flange 15, first end inner flange 16, first end plug means 17, first end seal means 18 and weir 19.

The first end inner surface 11 being cylindrical around the central container axis A—A and defining a first end inner channel 10 therewithin.

The first end inner channel 10 is in fluid flow communication with the central member inner chamber 32;

The second end side surface 22 is integrally joined to the central member outer cylindrical wall surface 30.

The second end inner surface 21 is integrally joined to the central member inner cylindrical wall surface 31.

The second end outer flange 24 extends away from the central container axis A—A and is integrally connected to the second end upper side surface 20.

The second end outer flange 24 is integrally connected to the second end lower side surface 22 along a circular curved portion of the second end lower side surface. The circular curved portion of the second end lower side surface 22 has a central axis which is coaxial with the central container axis A—A.

The second plug means 25 comprises a central cylindrical member 28 having a channel 29 extending diametrically through the central cylindrical member, and a lip 33 extending circumferentially around and integrally attached to the central cylindrical member.

The second plug central cylindrical member 28 engages the second end inner surface 21 in fluid sealing contact. The second plug lip 33 engages the second end top surface 23 in fluid sealing contact.

The second end seal means 26 has a cylindrical side member 34 and a circular top member 35.

The second end seal side member 26 has a lower flange 36.

The lower flange of the second end seal side member 34 engages the second end outer flange 24.

The second end seal top member 35 presses against the second plug lip 33 forcing the lip 33 against the second end top surface 23, thereby forming a vacuum tight seal diametrically across the central container axis A—A in the plane of the second end top surface 23.

The first end upper side surface 12 is integrally joined to the central member outer cylindrical wall surface 30.

The first end inner surface 11 is integrally joined to the central member inner cylindrical wall surface 31.

The first end outer flange 15 extending away from the central container axis A—A and integrally connected to the first end lower side surface 13.

The first end outer flange 15 is integrally connected to the first end upper side surface 12 along a circular curved portion of the first end upper side surface 12. The circular curved portion of the first end upper side surface 12 has a central axis which is coaxial with the central container axis A—A.

The first plug means comprising a cylindrical member 17.

The first end seal member 18 comprises a cylindrical side member 37 and a circular bottom member 38. The first end seal side member has a lower flange 39. The lower flange 39 of the first end seal side member engages the first end outer flange 15. The first end bottom member 38 presses against the first plug cylindrical member 17 forcing the first plug 17 against the first end bottom surface 14 thereby forming a vacuum tight seal diametrically across the central container axis A—A in the plane of the first end bottom surface 14.

The weir 19 has a support flange 42, a plurality of centering flanges 43 and a central weir channel 40 defined by inner weir wall 41.

The central weir channel 40 is in fluid flow communication with the central member inner chamber 32.

The weir 19 has a central axis which is coaxial with the central container axis A—A.

Figure 2:
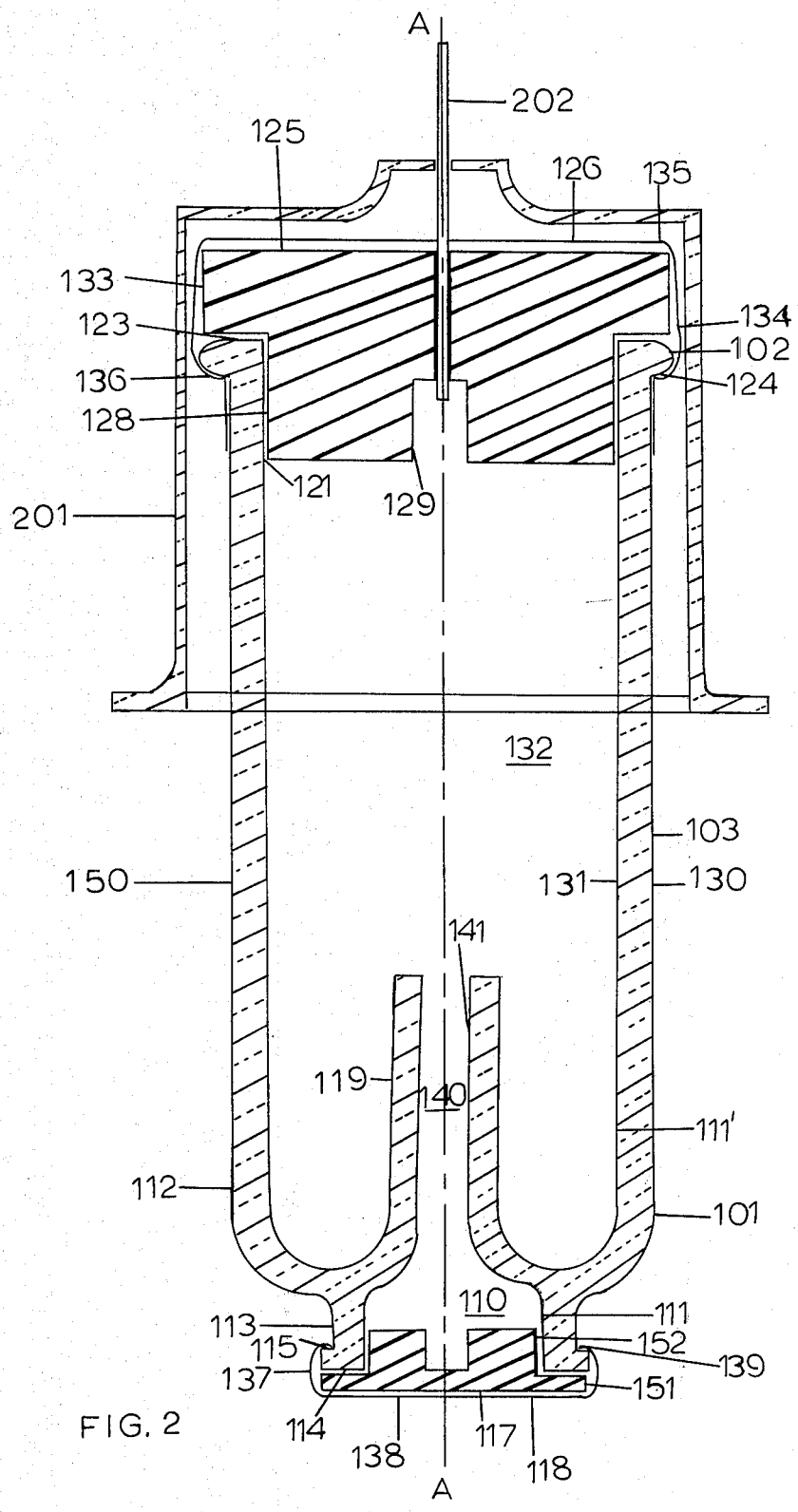
FIG. 2 is a cross sectional view of a centrifuge container tube supported by a hypodermic syringe needle holder in accordance with the invention.

Another preferred embodiment of the invention is shown in FIG. 2. The container 150 is shown with a hypodermic syringe needle holder 201. The hypodermic syringe needle 202 is supported by the holder 201 and penetrates the second end plug means 125.

The container 150 has a first end member 101, a second end member 102 and a central member 103. The first end member is integrally attached to the central member. The second end member is integrally attached to the central member.

The central member 103 is substantially cylindrical around a central centrifuge tube container axis A—A. The central member 103 has an outer cylindrical wall surface 130 an inner cylindrical wall surface 131. The central member inner surface 131 defines a central member inner chamber 132.

The second end member 102 has a second end inner surface 121, second end top surface 123, second end outer flange 124, second end plug means 125 and second end seal means 126.

The second end inner surface 121 is cylindrical around the central container axis, A—A.

The first end member 101 has a first end inner surface 111, first end upper side surface 112 and first end lower side surface 113, first end bottom surface 114, first end outer flange 115, first end plug means 117, first end seal means 118 and weir 119.

The first end inner surfaces 111 being cylindrical around the central container axis A—A and defining a first end inner channel 110 therewithin.

The first end inner channel 110 is in fluid flow communication with the central member inner chamber 132.

The second end outer flange 124 extends away from the central container axis A—A.

The second plug means 125 comprises a central cylindrical member 128 having a channel 129 extending diametrically through the central cylindrical member, and a lip 133 extending circumferentially around and integrally attached to the central cylindrical member.

The second plug central cylindrical member 128 engages the second end inner surface 121 in fluid sealing contact. The second plug lip 133 engages the second end top surface 123 in fluid sealing contact.

The second end seal means 126 has a cylindrical side member 134 and a circular top member 135.

The second end seal side member 126 has a lower flange 136.

The lower flange 136 of the second end seal side member 134 engages the second end outer flange 124.

The second end seal top member 135 presses against the second plug lip 133 forcing the lip 133 against the second end top surface 123, thereby forming a vacuum tight seal diametrically across the central container axis A—A at the second end top surface 123.

The first end upper side surface 112 is integrally joined to the central member outer cylindrical wall surface 130.

The first end inner surface 111' is integrally joined to the central member inner cylindrical wall surface 131.

The first end outer flange 115 extending away from the central container axis A—A and integrally connected to the first end lower side surface 113.

The first end outer flange 115 is integrally connected to the first end upper side surface 112 along a circular curved portion of the first end upper side surface 112. The circular curved portion of the first end upper side surface 112 has a central axis which is coaxial with the central container axis A—A.

The first plug means 117 comprising a cylindrical member 152 and a lip 151.

The first end seal member 118 comprises a cylindrical side member 137 and a circular bottom member 138. The first end seal side member has a lower flange 139. The lower flange 139 of the first end seal side member engages the first end outer flange 115. The first end seal bottom member 138 presses against the first plug cylindrical member 152 forcing the first plug lip 151 against the first end bottom surface 114 thereby forming a vacuum tight seal diametrically across the central container axis A—A in the plane of the first end bottom surface 114.

The first weir 119 has a central weir channel 140 defined by inner weir wall 141.

The central weir channel 140 is in fluid flow communication with the central member inner chamber 132.

The weir 119 has a central axis which is coaxial with the central container axis A—A.

The inner weir wall 141 is integrally connected to the first end inner surface 111.

A preferred method of using the container of the invention is as follows:

(i) Draw patient's blood into a partially evacuated tube containing a lyophilized formulation comprising sodium heparin, stannous fluoride, sodium citrate, and ascorbic acid, and mix the contents gently.

(ii) Add saline solution to the tube (and withdraw the same volume of air to prevent any pressure build up in the tube. Then rotate the tube a few times.

(iii) Centrifuge the tube.

(iv) Withdraw the supernatant through the weir and discard it.

(v) Add the necessary technetium-99m activity (as $Na^+TcO_4^-$) in saline solution to the receptacle and then add sodium hypochlorite to the solution. The receptacle is mixed gently for 5 minutes.

(vi) Inject the patient with the labeled red blood cells blood.

The blood may be drawn for step (i) by placing the container in a hypodermic syringe needle holder (for example the produce sold under the trademark: VACUTAINER holder, trademark owned by Becton Dickinson) as should in FIG. 2, after the hypodermic syring needle has penetrated the patient's skin. In placing the container in the hypodermic syringe needle holder the hypodermic needle penetrates the plug (plug means 125 in FIG. 2). The vacuum in the container draws the blood from the patient into the central member inner chamber 132.

The supernatant is withdrawn in step (iv) above by holding the container vertically with the weir end down. A syringe needle is then moved into the central weir chamber and the supernatant withdrawn. The container contents is thus lowered to level L (shown in FIG. 1)

The labeled cells may be injected into the patient for the purposes of step (vi) by withdrawing the labeled cells out of the central member inner chamber with a hypodermic syringe. The syringe needle penetrates a plug and enters the central member inner chamber. The blood thus withdrawn from the central member inner chamber is injected into the patient.

The use of the invention may be by first mixing a blood sample with a formulation comprising anticoagulant, stannous ion and buffer. It is preferred that the blood sampling and mixing be accomplished with a single container. This is readily accomplished by supplying the formulation in a partially evacuated container which when coupled with a hypodermic needle can be used to obtain the necessary blood sample.

Saline solution is added to the mixture, and the mixture is shaken and centrifuged to pack the red blood cells.

After centrifugation, the supernatant is separated from the red blood cells. This can be accomplished by withdrawing either the supernatant or the red blood cells from the container. It is preferred that supernatant be withdrawn and discarded, and that the process continue in the same container.

Labeling of the red blood cells is accomplished by mixing radioactive pertechnetate ion ($^{99m}TcO_4^-$) and oxidizing agent with the red blood cells. The radioactive pertechnetate ion is readily obtainable as a saline solution of radioactive sodium pertechnetate by elution of commercial generators with saline; see, for example, U.S. Pat. Nos. 3,920,995, issued Nov. 18, 1975.

The oxidizing agent and pertechnetate ion can be mixed first and then mixed with the red blood cells or they can be mixed with the red blood cells separately, without regard to which is added first.

The weir is adapted to provide for leaving a known volume of red blood cells in the container. The height of the weir is made so that upon collecting a predetermined amount of blood, most of the red blood cells will be contained below this weir after centrifuging and all of the plasma will be above the weir.

The most preferred material of construction for the container is glass. For economic reasons plastic may be used, but glass holds a vacuum better. The vacuum inside the container before taking the patient's blood is 16–17 in. Hg. In a most preferred embodiment of the invention the weir is made of rigid or semi-rigid plastic such as polypropylene. The plugs are preferably constructed of flexible plastic or rubber. The seals preferably are constructed of metal or plastic. When a plastic seal is used the plastic may be heat formed to the container.

It is within the scope of the invention to provide a container having only a first plugged end with a weir. The second end would not have an opening. More preferred is to provide a container having two apertures, one on each end. Both plugged. This is advantageous during removal of the labeled red blood cells from the container with a syringe. The syringe may penetrate one end while a venting tube penetrates the other end to avoid a build up of vacuum.

Although, less convenient a venting needle and a syringe hypodermic needle may both be positioned into the weir channel.

Where the seal means of the present invention are constructed of metal a circular perforation is provided in its center. The center of the circular perforation being located on the axis A—A. The portion within the circular perforation may be removed prior to penetrating the plug means thereunder.

What is claimed is:

1. A centrifuge tube container comprising a container tube, a first resilient plug, and a weir separate and distinct from said first resilient plug;

said container tube comprising a central chamber wall defining a central chamber and a lower chamber wall having a first container aperture, said weir being supported within said first aperture;

said weir including a first end portion extending at a predetermined distance from said first resilient plug into said central chamber thereby defining a predetermined level above said first resilient plug, said weir further including a channel wall spaced from the central chamber wall and defining a central channel directly opening into and in fluid communication with said central chamber so that fluids and solids present in said central chamber may be centrifuged down and solids collected below the level of the first end portion of said weir, said central channel of said weir being adapted to receive and guide a hypodermic needle to extend beyond the first end portion of said weir and to withdraw fluid from said central chamber at a level above said first end portion of said weir;

said first resilient plug sealingly engaging said weir in said first container aperture;

said container tube further comprising an upper chamber wall having a second container aperture and a second resilient plug, said second resilient plug sealingly engaging said second container aperture.

2. The container of claim 1 wherein said container tube further comprises an upper chamber wall having a second container aperture and a second resilient plug;

said second resilient plug sealingly engaging said second container aperture.

3. The container of claim 1 wherein said weir further comprises at least one centering flange.

4. The container of claim 1 wherein said weir further comprises a support flange.

5. The container of claim 4 wherein said weir further comprises at least one centering flange.

6. The container of claim 1 wherein said weir is integrally connected to said central chamber wall.

7. The container of claim 1 wherein said container tube is made of glass.

8. The container of claim 7 wherein said weir is made of rigid or semi-rigid plastic material.

9. The container of claim 1 in combination with a hypodermic syringe needle and a hypodermic syringe needle holder whereby said hypodermic syringe needle extends into said central chamber and said hypodermic syringe needle holder supports said container tube.

10. A centrifuge tube container comprising a first end member, a second end member and a central member, said first end member being integrally attached to said central member, said second end member being integrally attached to said central member;

said central member being substantially cylindrical having outer and inner cylindrical wall surfaces;

said second end member comprising a second end inner surface, second end upper side surface, second end lower side surface, second end top surface, second end outer flange, second end plug means and second end seal means;

said second end inner surface being cylindrical around said central container axis and defining a second end inner channel therewithin;

said second end inner channel being in fluid flow communication with said central member inner chamber;

said first end member comprising a first end inner surface, first end upper side surface, first end lower side surface, first end bottom surface, first end outer flange, first end inner flange, first end plug means, first end seal means and weir means;

said first end inner surface being cylindrical around said central container axis and defining a first end inner channel therewithin;

said first end inner channel being in fluid flow communication with said central member inner chamber;

said second end side surface being integrally joined to said central member outer cylindrical wall surface;

said second end inner surface being integrally joined to said central member inner cylindrical wall surface;

said second end outer flange extending away from said central container axis and integrally connected to said second end upper side surface;

said second end outer flange being integrally connected to said second end lower side surface along a circular curved portion of said second end lower side surface; said circular curved portion of said second end lower side surface having central axis which is coaxial with said central container axis;

said second plug means comprising a central cylindrical member having a channel extending diametrically through said central cylindrical member, and a lip extending circumferentially around and integrally attached to said central cylindrical member;

said second plug central cylindrical member engaging said second end inner channel in fluid sealing contact;

said second end seal means comprising a cylindrical side member and a perforated circular top member;

said second end seal side member having a lower flange, said lower flange of said second end seal side member engaging said second end outer flange;

said second end seal member perforated top member presses against said second plug lip forcing said lip against said second end top surface, thereby forming a vacuum tight seal;

said first end side surface being integrally joined to said central member outer cylindrical wall surface;

said first end inner surface being integrally joined to said central member inner cylindrical wall surface;

said first end outer flange extending away from said central container axis and integrally connected to said first end upper side surface;

said first end outer flange being integrally connected to said first end lower side surface along a circular curved portion of said first end upper side surface; said circular curved portion of said first end upper side surface having central axis which is coaxial with said central container axis;

said first plug means comprising a cylindrical member;

said first end seal member comprises a cylindrical side member and a circular bottom member, said first end seal side member having a lower flange; said lower flange of said first end seal side member engaging said first end outer flange; said first end bottom member pressing against said first plug cylindrical member forcing said first plug against said first end bottom surface thereby forming a vacuum tight seal diametrically across said central container axis at said first end bottom surface; said weir having a support flange, a plurality of centering flanges and a central weir channel defined by an inner weir wall;

said central weir channel being in fluid flow communication with said central member inner chamber (32), said weir (19) having a central axis being coaxial with the central container axis.

* * * * *